US012071953B2

(12) United States Patent
Okuda et al.

(10) Patent No.: US 12,071,953 B2
(45) Date of Patent: Aug. 27, 2024

(54) AXIAL FAN

(71) Applicant: SANYO DENKI CO., LTD., Tokyo (JP)

(72) Inventors: Yusuke Okuda, Tokyo (JP); Hiromitsu Kuribayashi, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 17/896,708

(22) Filed: Aug. 26, 2022

(65) Prior Publication Data

US 2023/0100236 A1 Mar. 30, 2023

(30) Foreign Application Priority Data

Sep. 24, 2021 (JP) ..... 2021-155546

(51) Int. Cl.

| | |
|---|---|
| ***F04D 25/06*** | (2006.01) |
| ***F04D 19/00*** | (2006.01) |
| ***F04D 29/02*** | (2006.01) |
| ***F04D 29/056*** | (2006.01) |

(52) U.S. Cl.

CPC ..... *F04D 19/007* (2013.01); *F04D 19/002* (2013.01); *F04D 25/06* (2013.01); *F04D 29/023* (2013.01); *F04D 29/056* (2013.01)

(58) Field of Classification Search

CPC ..... F04D 19/007; F04D 19/02; F04D 25/166; F04D 29/601; F16B 2/065; F16B 5/0072; F16B 5/0275; F16B 2200/403

See application file for complete search history.

(56) References Cited

U.S. PATENT DOCUMENTS 4,164,852 A * 8/1979 Anzalone ..... F24F 13/00 62/262
6,547,540 B1 * 4/2003 Horng ..... F04D 29/646 417/423.5
7,031,157 B2 * 4/2006 Horng ..... H05K 7/20172 415/220

(Continued)

FOREIGN PATENT DOCUMENTS

JP 8-28491 A 1/1996

OTHER PUBLICATIONS

Extended European Search Report (EESR) issued on Feb. 14, 2023 for the corresponding European Patent Application No. 22190941.9.

(Continued)

*Primary Examiner* — Thomas Fink
(74) *Attorney, Agent, or Firm* — RANKIN, HILL & CLARK LLP

(57) ABSTRACT

Provided is an axial fan including a pair of fan units, wherein each of the pair of fan units includes a rotor, a motor, and a housing, the rotor includes an impeller cup configured to rotate about a rotation axis, and a fan extending radially from the impeller cup, the motor is provided inside the impeller cup, the housing includes a housing portion housing the rotor, and a base portion supporting the motor, a connection portion is provided to an axial end surface of the base portion and on an inner peripheral side relative to the impeller cup, and the pair of fan units is connected to each other via the connection portions in a direction of the rotation axis.

9 Claims, 8 Drawing Sheets

(56) References Cited

U.S. PATENT DOCUMENTS 7,112,905 B2 * 9/2006 Chang ..... F04D 25/062 403/DIG. 7
7,156,611 B2 * 1/2007 Oosawa ..... F04D 19/007 415/199.5
7,541,702 B2 * 6/2009 Murakami ..... H02K 9/06 310/67 R
8,177,486 B2 * 5/2012 Lee ..... H05K 7/20172 415/214.1
8,277,178 B2 * 10/2012 Li ..... F04D 29/646 415/214.1
8,322,998 B2 12/2012 Hanaoka et al.
8,668,477 B2 3/2014 Wu et al.
8,932,014 B2 * 1/2015 Zhao ..... F04D 19/007 415/213.1
9,057,387 B2 * 6/2015 Sun ..... F04D 29/601
9,897,094 B2 * 2/2018 Kang ..... F04D 29/522
11,319,970 B2 * 5/2022 Masuo ..... F04D 19/024
2002/0094280 A1 * 7/2002 Lin ..... F04D 25/166 417/423.1
2002/0122733 A1 * 9/2002 Lin ..... F04D 29/522 417/423.5
2004/0247383 A1 12/2004 Chang et al.
2005/0260065 A1 * 11/2005 Kikuichi ..... F04D 25/166 415/60
2006/0045736 A1 * 3/2006 Lee ..... F04D 25/0613 415/220
2006/0083608 A1 * 4/2006 Sun ..... F04D 19/007 415/199.4
2007/0003413 A1 * 1/2007 Hsu ..... F04D 29/646 415/199.5
2007/0237625 A1 * 10/2007 Liang ..... F04D 29/601 415/119
2009/0214337 A1 * 8/2009 Yoshida ..... F04D 25/0613 415/214.1
2009/0246015 A1 * 10/2009 Hsu ..... F04D 19/007 415/213.1
2010/0033041 A1 * 2/2010 Watanabe ..... F04D 29/329 310/63
2010/0119385 A1 * 5/2010 Hanaoka ..... F04D 27/004 417/244
2010/0189544 A1 * 7/2010 Nakamura ..... F04D 29/668 415/68
2010/0329859 A1 * 12/2010 Chen ..... F04D 19/007 415/198.1
2012/0134856 A1 * 5/2012 Wu ..... F04D 19/002 417/350
2012/0163970 A1 * 6/2012 Shu ..... F04D 19/007 415/213.1
2012/0171057 A1 * 7/2012 Wu ..... F04D 25/0606 417/354
2013/0216372 A1 * 8/2013 Wang ..... F04D 29/646 415/213.1
2013/0315727 A1 * 11/2013 Ho ..... F04D 29/601 415/213.1
2015/0023786 A1 1/2015 Li et al.
2015/0226230 A1 * 8/2015 Chang ..... F04D 19/007 415/200
2015/0233392 A1 * 8/2015 Liu ..... F04D 29/668 415/213.1
2017/0241440 A1 * 8/2017 Barron ..... F04D 19/002
2021/0040960 A1 * 2/2021 Shih ..... F04D 29/522
2021/0277916 A1 * 9/2021 Ma ..... F04D 29/646

OTHER PUBLICATIONS

European Office Actiono issued on Jun. 11, 2024 for European Patent Application No. 22190941.9.

* cited by examiner

AXIAL FAN

CROSS-REFERENCE TO RELATED APPLICATION

This application is based on Japanese Patent Application No. 2021-155546 filed with the Japan Patent Office on Sep. 24, 2021, the entire content of which is hereby incorporated by reference.

BACKGROUND

1. Technical Field

The present disclosure relates to an axial fan.

2. Related Art

An axial fan is known which increases the air flow rate by use of a pair of fan units coupled in series.

In, for example, an axial fan disclosed in JP-A-8-28491, an outer peripheral side of an upstream fan unit of a pair of fan units is provided with a male thread. An outer peripheral side of a downstream fan unit is provided with a female thread. The male thread and the female thread are fastened together to couple the pair of fan units in series.

SUMMARY

An axial fan according to an embodiment of the present disclosure includes a pair of fan units, and each of the pair of fan units includes a rotor, a motor, and a housing. The rotor includes an impeller cup configured to rotate about a rotation axis, and a fan extending radially from the impeller cup. The motor is provided inside the impeller cup. The housing includes a housing portion housing the rotor, and a base portion supporting the motor. A connection portion is provided to an axial end surface of the base portion and on an inner peripheral side relative to the impeller cup. The pair of fan units is connected to each other via the connection portions in a direction of the rotation axis.

DETAILED DESCRIPTION

Figure 1:
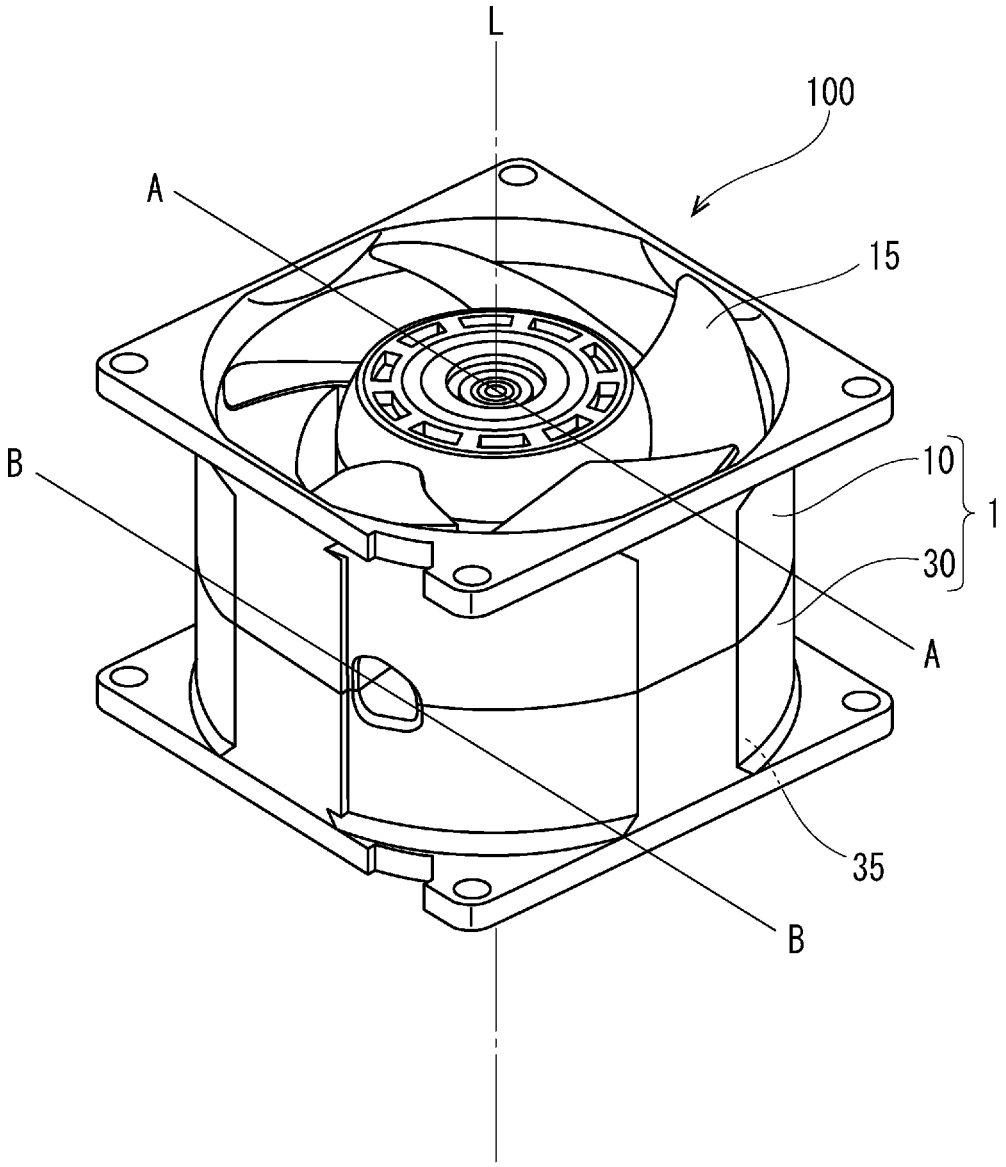
FIG. 1 is a perspective view of an axial fan according to a first embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Each of the pair of fan units disclosed in JP-A-8-28491 is provided with a bushing that supports a rotating shaft and a bearing, or a base portion of a housing, in a radially central part of the fan unit. Hence, when the pair of fan units is coupled to each other as a counter rotating fan, the two fan units are placed in such a manner that the bushings come into contact with each other in the central parts of the fan units. The bushings are not coupled directly to each other. Hence, wear debris may be produced by the friction between the metal bushings due to the vibration of the fans.

Hence, an object of the present disclosure is to provide an axial fan where wear is reduced.

An axial fan according to one aspect of the present embodiment includes a pair of fan units, and each of the pair of fan units includes a rotor, a motor, and a housing. The rotor includes an impeller cup configured to rotate about a rotation axis, and a fan extending radially from the impeller cup. The motor is provided inside the impeller cup. The housing includes a housing portion housing the rotor, and a base portion supporting the motor. A connection portion is provided to an axial end surface of the base portion and on an inner peripheral side relative to the impeller cup. The pair of fan units is connected to each other via the connection portions in a direction of the rotation axis.

According to the embodiment, it is possible to reduce wear debris from being produced by the friction between the connection portions due to the vibration of the fans.

Embodiments of the present disclosure are described hereinafter with reference to the drawings. Descriptions of members having the same reference numerals as members already described in the detailed description are omitted for the convenience of description. Moreover, the dimensions of each member illustrated in the drawings may be different from actual dimensions thereof for the convenience of description.

First Embodiment

FIG. 1 is a perspective view illustrating an example of an axial fan according to a first embodiment of the present disclosure. As illustrated in FIG. 1, an axial fan 100 includes a fan unit pair 1. The fan unit pair 1 includes an upstream fan unit 10 and a downstream fan unit 30, which are connected in series to each other. The fan units 10 and 30 share a rotation axis L of fans.

The axial fan 100 is a counter rotating fan where the rotation direction of a fan 15 of the upstream fan unit 10 is different from the rotation direction of a fan 35 of the downstream fan unit 30. Air that is drawn in through the fan 15 of the upstream fan unit 10 is blown out through the fan 35 of the downstream fan unit 30. The axial fan 100 according to the embodiment is a counter rotating fan including two fans that rotate in different directions from each other. In the configuration of the axial fan 100, however, two fans that rotate in the same direction may be connected in series.

Figure 2:
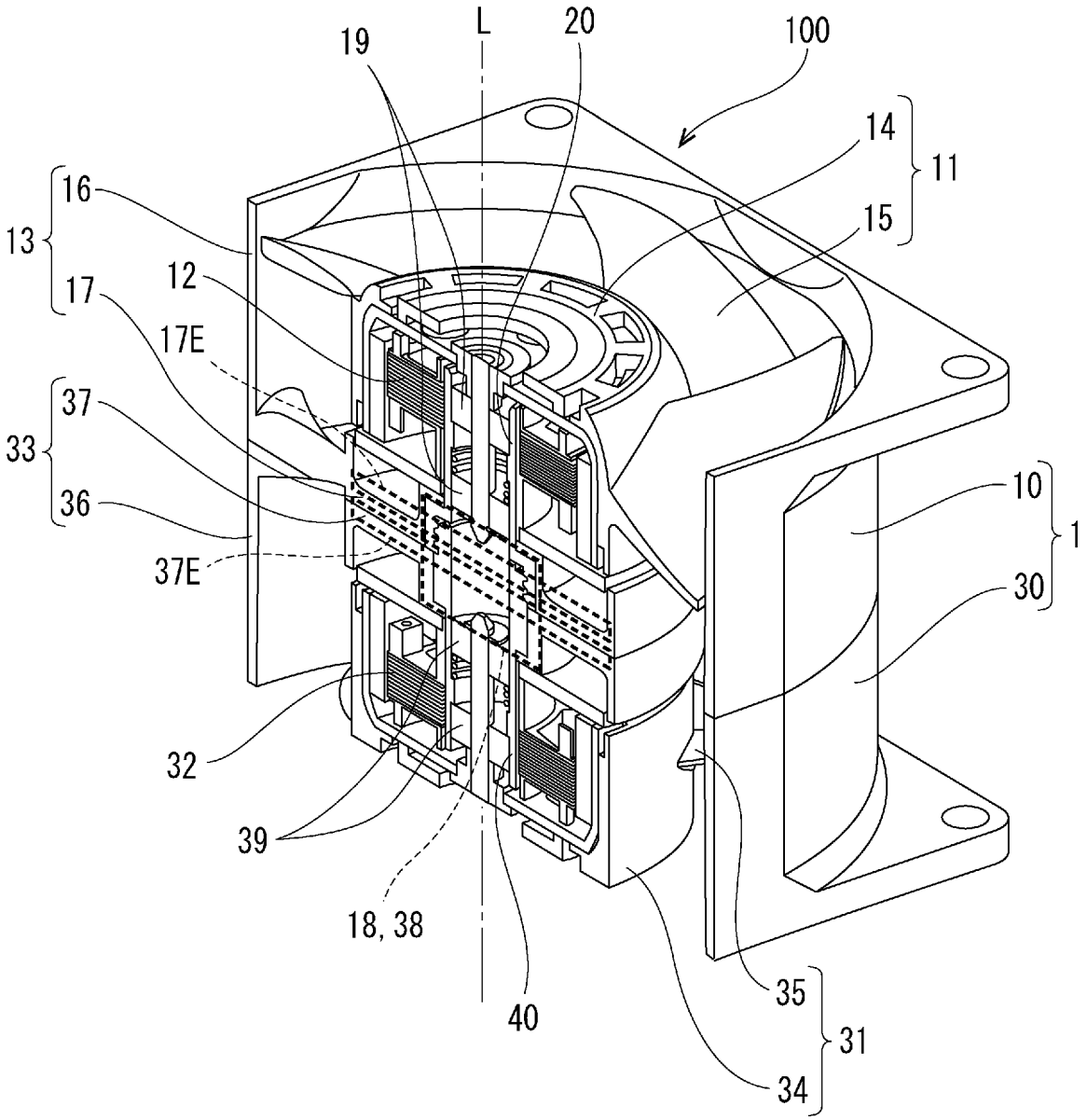
FIG. 2 is a cross-sectional perspective view along A-A in FIG. 1.
Figure 3:
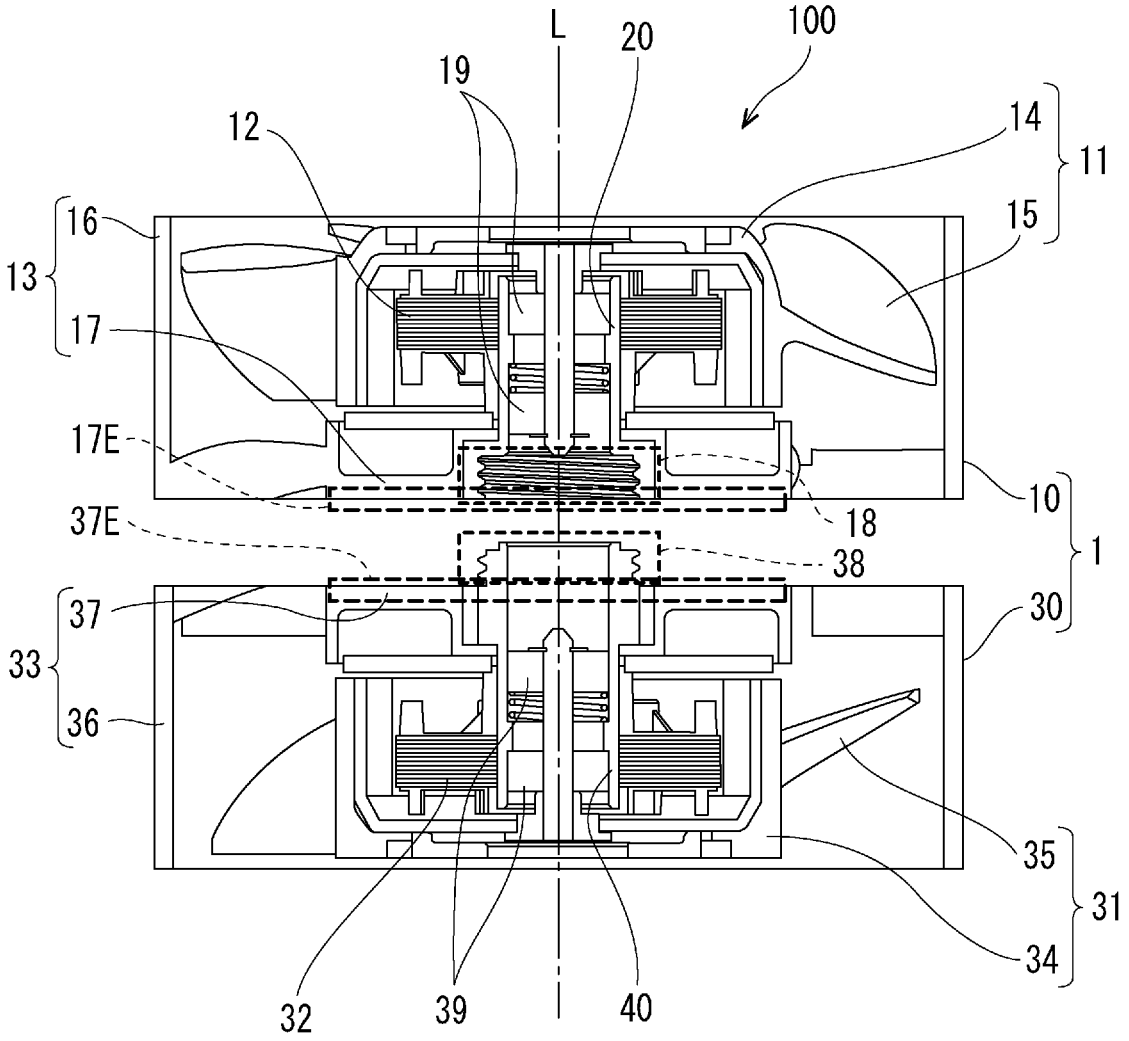
FIG. 3 is a cross-sectional view along A-A in FIG. 1.

FIGS. 2 and 3 are cross-sectional perspective views along A-A in FIG. 1. For the description's sake, FIG. 3 illustrates the configuration of the axial fan 100 before the fan units 10 and 30 are connected together.

As illustrated in FIGS. 2 and 3, the fan unit 10 includes a rotor 11, a motor 12, and a resin housing 13. The rotor 11 includes an impeller cup 14 that rotates about the rotation axis L, and the fan 15 extending radially from the impeller cup 14. The motor 12 is provided inside the impeller cup 14. The housing 13 includes a housing portion 16 that houses the rotor 11, and a base portion 17 that supports the motor 12.

Similarly, the fan unit 30 includes a rotor 31, a motor 32, and a resin housing 33. The rotor 31 includes an impeller cup 34 that rotates about the rotation axis L, and the fan 35 extending radially from the impeller cup 34. The motor 32 is provided inside the impeller cup 34. The housing 33 includes a housing portion 36 that houses the rotor 31, and a base portion 37 that supports the motor 32. The fan unit 30 has a configuration similar to that of the fan unit 10. Hence, reference numerals similar to those of the fan unit 10 are assigned to portions of the fan unit 30 in the following description. The details of the fan unit 10 are described instead of the detailed description of the fan unit 30.

The impeller cup 14 is a cup-shaped member that opens on one side in the axial direction. The motor 12 is provided inside the impeller cup 14. The impeller cup 14 is connected to a mover of the motor 12. The motor 12 rotates the fan 15 fixed to the impeller cup 14.

Figure 4:
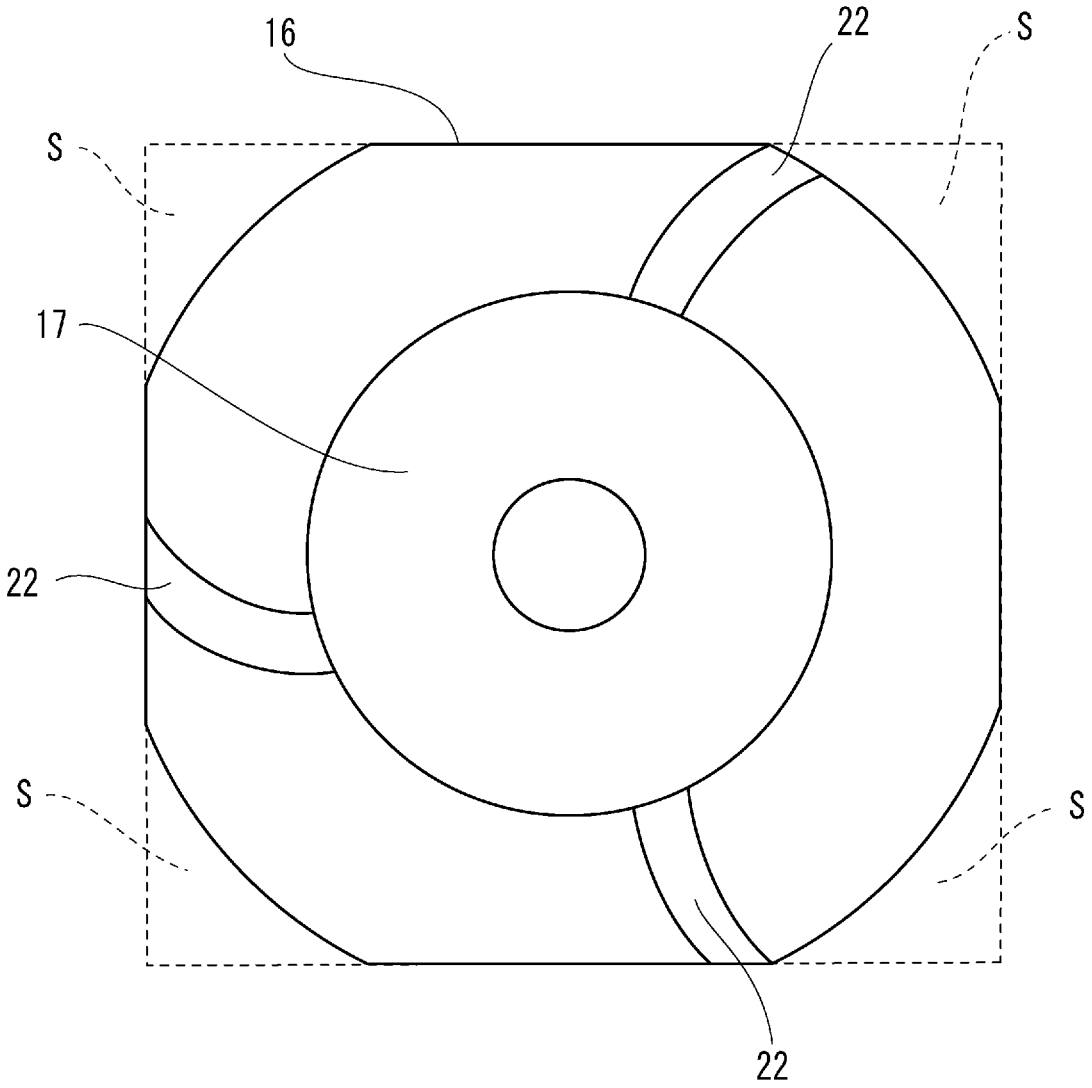
FIG. 4 is a cross-sectional view along B-B in FIG. 1.

FIG. 4 is a cross-sectional view along B-B orthogonal to the rotation axis L in FIG. 1. As illustrated in FIGS. 3 and 4, the housing 13 includes the round tubular housing portion 16 extending in a direction of the rotation axis L, the disc-shaped base portion 17 located in an opening of the housing portion 16 on the one side in the axial direction, and a plurality of spoke portions 22 that connect the housing portion 16 and the base portion 17. The rotor 11 is rotatably housed inside the round tubular housing portion 16.

The base portion 17 has a disc shape extending in a direction orthogonal to the rotation axis L. A circuit board that drives a stator of and the mover of the motor 12 is fixed to the base portion 17. The base portion 17 is similar in size and shape to the impeller cup 14 as viewed in the direction of the rotation axis L. Consequently, a current of air produced by the fan 15 extending radially from the impeller cup 14 is not blocked by the base portion 17.

The base portion 17 is placed away from the housing portion 16 as viewed in the direction of the rotation axis L. The spoke portions 22 are provided in the space between the base portion 17 and the housing portion 16. The spoke portions 22 extend radially from the base portion 17, and connect the base portion 17 and the housing portion 16. The spoke portions 22 may not only simply connect the base portion 17 and the housing portion 16, but also be provided as stator blades that straighten a current of air produced by the fan 15.

In the fan unit 10 of the embodiment, a connection portion 18 is provided to an axial end surface 17E of the base portion 17 and on an inner peripheral side relative to the impeller cup 14. In the illustrated example, the connection portion 18 includes a screw fastening portion. Similarly, in the fan unit 30, a connection portion 38 is provided to an axial end surface 37E of the base portion 37 and on an inner peripheral side relative to the impeller cup 34. The axial end surfaces 17E and 37E face each other.

The upstream fan unit 10 and the downstream fan unit 30 are connected to each other via the connection portions 18 and 38 in the direction of the rotation axis L.

In the illustrated example, the fan unit 10 includes a bearing 19 that supports the rotor 11 in such a manner that the rotor 11 is rotatable relative to the base portion 17. An inner ring member of the bearing 19 is fixed to the rotor 11. An outer ring member of the bearing 19 is fixed to a bushing 20 provided to the base portion 17. In other words, the base portion 17 includes the bushing 20 that supports the bearing 19.

The bushing 20 is made of metal such as aluminum or brass, and insert molded in a central part of the base portion 17. The bushing 20 is a round tubular member. The bearing 19 is press-fitted to an inner peripheral surface of the bushing 20. Specifically, a central part, in the direction of the rotation axis L, of the inner peripheral surface of the bushing 20 is provided with a small-diameter portion. Both end portions in the direction of the rotation axis L are each provided with a large-diameter portion of which inner diameter is larger than the inner diameter of the small-diameter portion. The bearing 19 is press-fitted from the large-diameter portion toward the center in the direction of the rotation axis L. A position where the bearing 19 comes into contact with the small-diameter portion is determined as a position of the bearing 19 in the direction of the rotation axis L.

The axial end surface 17E of the base portion 17 is provided with the connection portion 18. In the illustrated example, the connection portion 18 is a round tubular part extending in the direction of the rotation axis L. A female thread is provided on an inner peripheral surface of the round tubular connection portion 18. The bushing 20 and the connection portion 18 are formed as an integral metal member.

On the other hand, the base portion 37 of the fan unit 30 includes a round tubular bushing 40. The axial end surface 37E of the base portion 37 is provided with the connection portion 38. The connection portion 38 has a round tubular shape extending in the direction of the rotation axis L. A male thread that mates with the female thread of the connection portion 18 is provided on an outer peripheral surface of the round tubular connection portion 38. The inner diameter of an inner peripheral surface of the connection portion 38 is larger than the outer diameter of a bearing 39 to allow the bearing 39, which is to be press-fitted, to be inserted through the connection portion 38.

In the axial fan 100 according to the embodiment, the connection portions 18 and 38 are provided respectively to the axial end surfaces 17E and 37E of the base portions 17 and 37 and on the inner peripheral sides relative to the impeller cups 14 and 34. The fan units 10 and 30 are connected to each other via the connection portions 18 and 38 in the direction of the rotation axis L.

In other words, in contrast to the axial fan disclosed in JP-A-8-28491, the connection portions 18 and 38 provided on the inner peripheral sides connect the fan units 10 and 30 in the axial fan 100 according to the embodiment. Hence, it is possible to reduce the production of the friction between the metal bushings 20 and 40 located on the inner peripheral sides of the fan units 10 and 30 even if the fan units 10 and 30 vibrate. Hence, it is possible to reduce wear debris from being produced.

Moreover, in the above-mentioned embodiment, the housings 13 and 33 are made of resin. The bushings 20 and 40 are made of metal. In other words, the housings 13 and 33 are made of resin, which is lightweight. On the other hand, the bushings 20 and 40, which require strength, are made of metal. Consequently, it is possible to realize a firm connection structure while promoting a reduction in the total weight of the axial fan 100.

Figure 8:
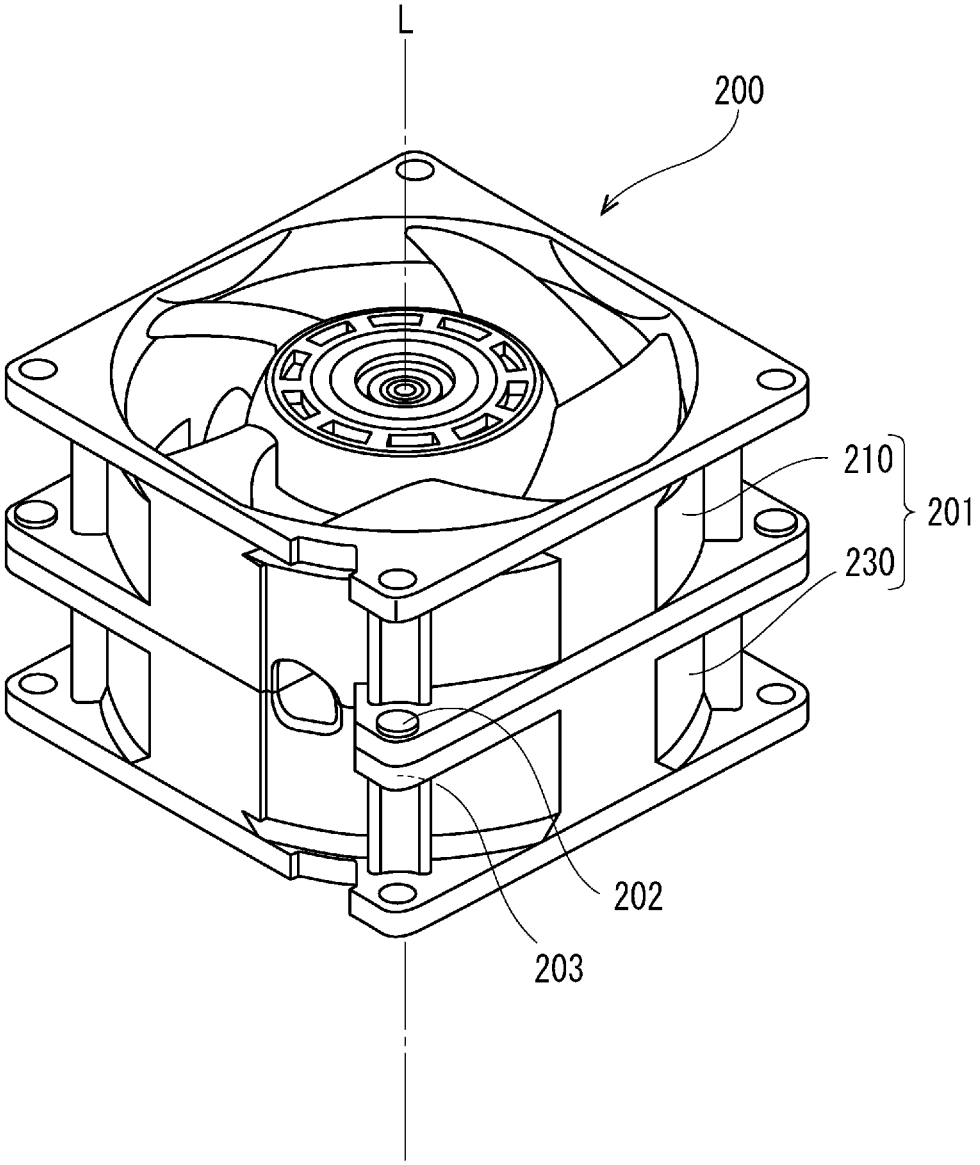
FIG. 8 is a perspective view of a general axial fan.

Moreover, the connection portions 18 and 38 are provided on the inner peripheral sides as mentioned above. As a result, it is easy to handle a lead wire. This effect is described by use of FIGS. 4 and 8. FIG. 8 is a perspective view of a general axial fan.

In an example illustrated in FIG. 8, a male thread 202 and a female thread 203 (corresponding to the connection portions) are provided on outer peripheral sides of the housing portions. Therefore, the male thread 202 and the female thread 203 are located in spaces on the outer peripheral sides of the housing portions. Hence, it may hinder the routing of the lead wire drawn from the housing portion to the outer peripheral side.

In contrast, the connection portions 18 and 38 are provided on the inner peripheral sides in the axial fan 100 according to the embodiment. Hence, the regions occupied by the connection portions in the example of FIG. 8 can be used for other purposes. Hence, as illustrated in FIG. 4, exit spaces S for the lead wire (not illustrated) to be connected to the motor are free on the outer peripheral side of the housing portion 16 of the housing 13 in the axial fan 100 according to the embodiment. In other words, there are no other members in the exit spaces S being the regions on the radially outer side of the housing portion 16. Hence, the lead wire can be placed, using the exit spaces S freely.

In the above-mentioned embodiment, positioning portions that determine the positions of the fan units 10 and 30 in the peripheral direction may be provided.

Figure 5:
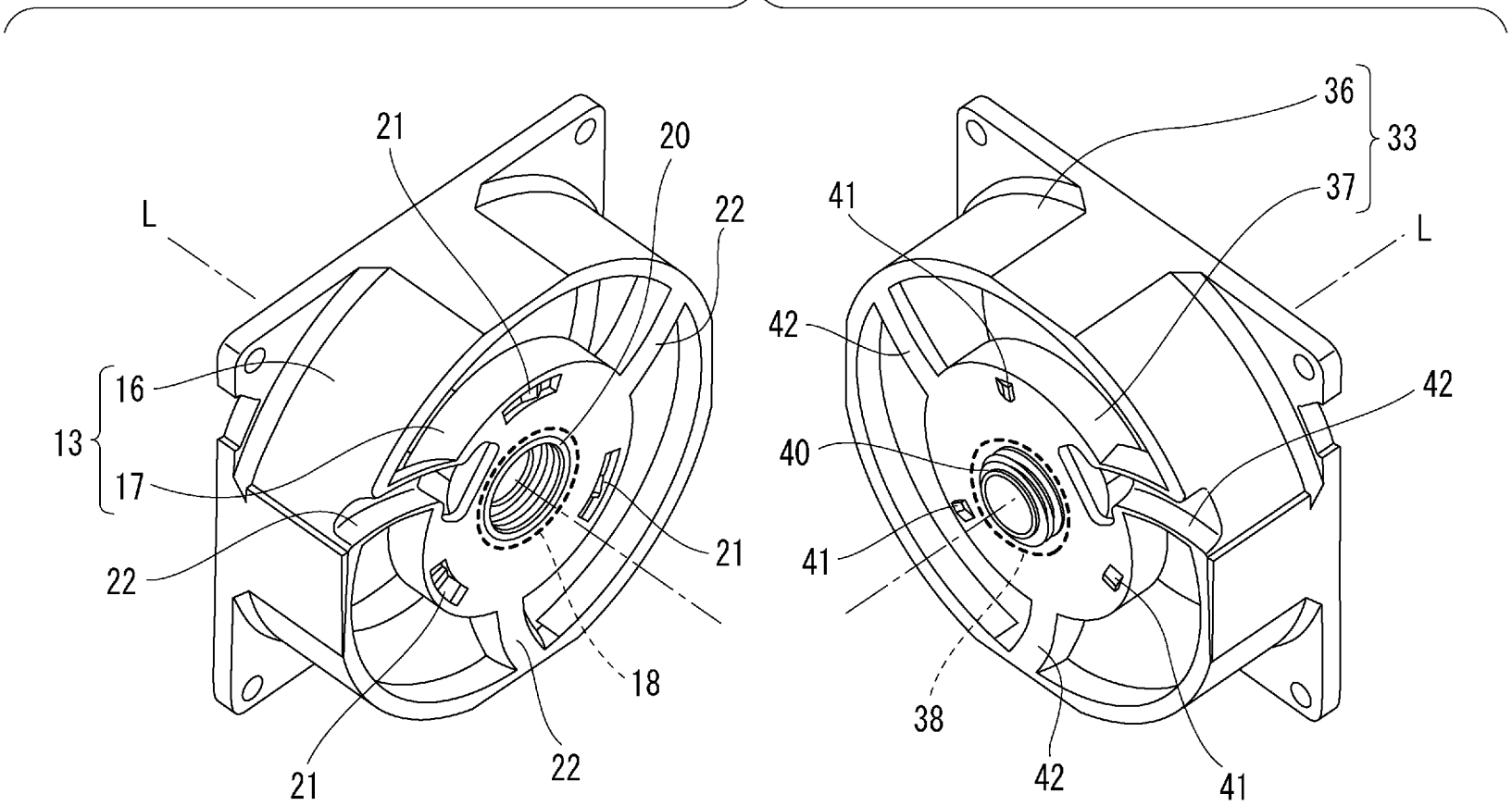
FIG. 5 is a perspective view of a pair of housings according to the first embodiment of the present disclosure.

FIG. 5 is a perspective view of a pair of the housings 13 and 33 according to the first embodiment of the present disclosure. A plurality of positioning portions 21 and 41 is provided to the axial end surfaces 17E and 37E of the base portions 17 and 37 of the housings 13 and 33, respectively. The positioning portion 21 is a positioning-purpose groove. The positioning portion 41 is a positioning-purpose claw. Moreover, the positioning-purpose groove and the positioning-purpose claw have shapes adjusted for thread engagement in such a manner as to be guided by each other along the rotation direction of the male thread of the connection portion 38. Consequently, it is easy to determine the positions of the pair of the housings 13 and 33 when the upstream fan unit 10 and the downstream fan unit 30 are connected together.

Second Embodiment

In the above-mentioned embodiment, the example where a pair of the connection portions 18 and 38 is connected to each other by thread engagement has been described. However, the embodiment is not limited to the example.

Figure 6:
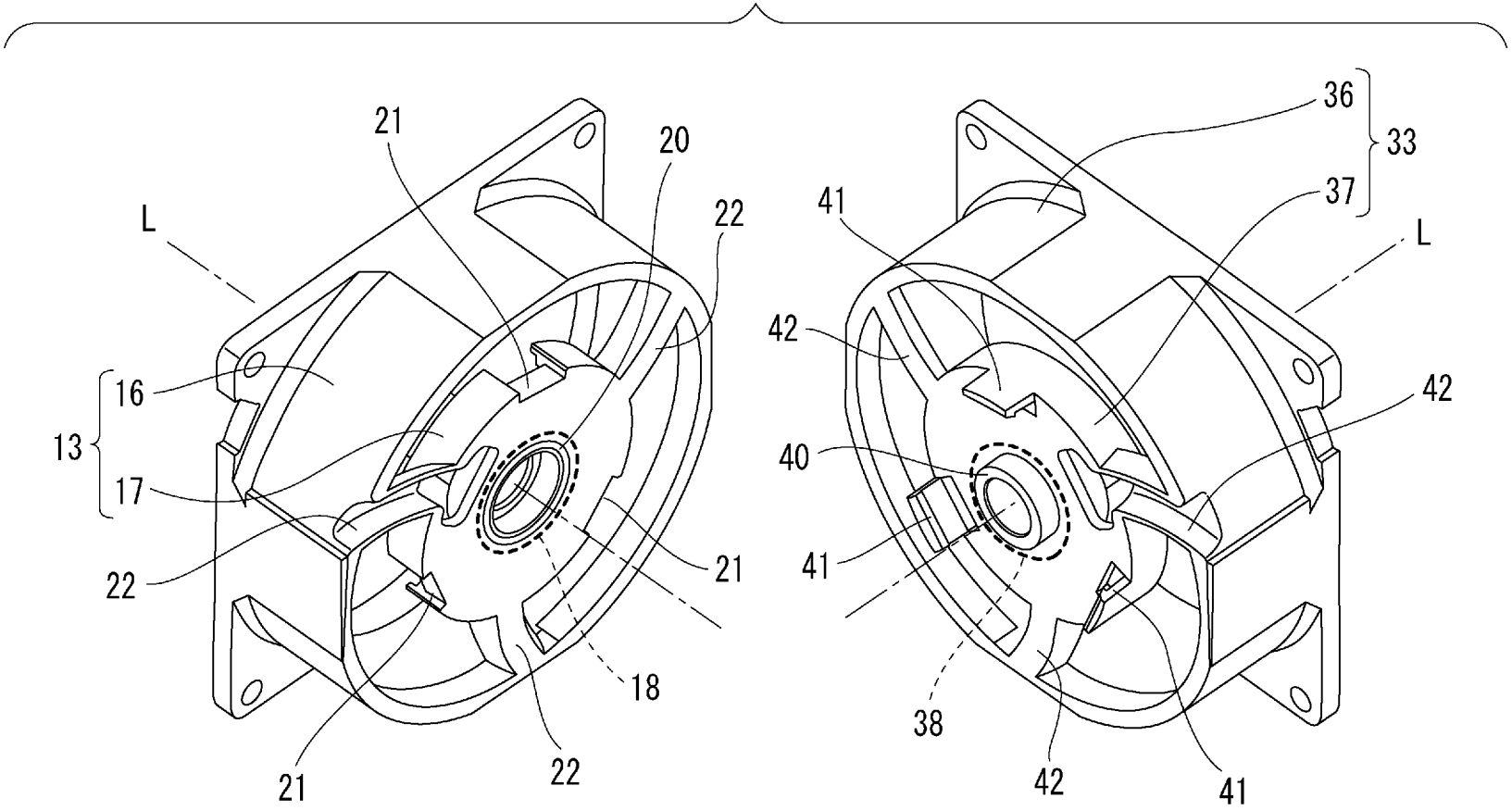
FIG. 6 is a perspective view of a pair of housings according to a second embodiment of the present disclosure.

FIG. 6 is a perspective view of the pair of the housings 13 and 33 according to a second embodiment of the present disclosure.

The second embodiment is different from the first embodiment of the present disclosure in the respect that the connection portions 18 and 38 are configured in such a manner as to be connected not by thread engagement but by engagement based on press-fitting.

The connection portion 18 includes a circular cylindrical recessed portion. The connection portion 38 includes a ring-shaped protruding portion. The inner diameter of an inner peripheral surface of the recessed portion is larger than the outer diameter of the protruding portion to allow the protruding portion, which is to be press-fitted, to be inserted through the recessed portion. Moreover, the plurality of positioning portions 21 and 41 has shapes adjusted for press-fitting in such a manner as to be guided along the direction of the rotation axis L. Consequently, the assembly work (connection work) of the axial fan 100 is easy.

Third Embodiment

Moreover, in the above-mentioned embodiments, the example where the connection portions 18 and 38 are provided in the central parts of the axial end surfaces 17E and 37E of the base portions 17 and 37 has been described. However, the embodiment is not limited to the example.

Figure 7:
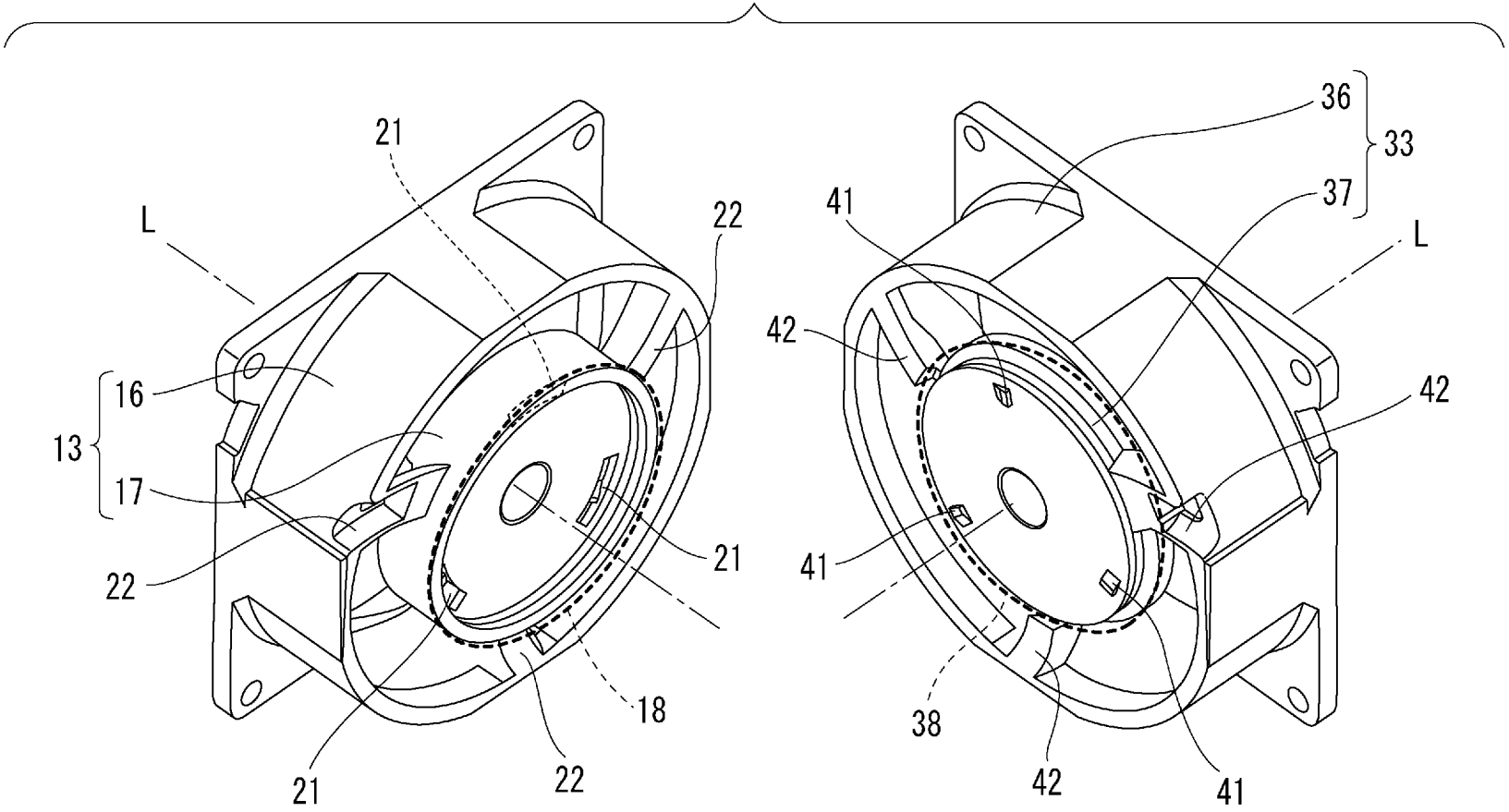
FIG. 7 is a perspective view of a pair of housings according to a third embodiment of the present disclosure.

FIG. 7 is a perspective view of the pair of the housings 13 and 33 according to a third embodiment of the present disclosure. The third embodiment is different from the above-mentioned first embodiment in the respect that the connection portions 18 and 38 are provided not only in the central parts of the axial end surfaces 17E and 37E of the base portions 17 and 37 but all over the axial end surfaces 17E and 37E. Consequently, it is possible to sufficiently ensure the mating areas of the connection portions 18 and 38. Hence, the connection portions 18 and 38 can be connected firmly. Furthermore, the third embodiment is different from the first embodiment of the present disclosure in the respect that the housings 13 and 33 and the bushings 20 and 40 are not made of resin and metal, respectively, but are integrally-molded pieces made of metal such as aluminum. Consequently, it is possible to promote an improvement in the strength and heat dispersion performance of the entire axial fan.

Up to this point the embodiments of the present disclosure have been described. However, it is needless to say that the technical scope of the embodiments should not be construed in a limited manner by the above-mentioned detailed description. The embodiments that have been described are mere examples. Those skilled in the art understand that the embodiments can be modified in various manners within the scope of disclosure described in the claims. The technical scope of the embodiments should be determined on the basis of the scope of disclosure described in the claims and the scope of equivalents thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising a first fan unit and a second fan unit, wherein each of the first fan unit and the second fan unit includes a rotor, a motor, a housing, and a bearing, the rotor includes an impeller cup configured to rotate about a rotation axis, and a fan extending radially from the impeller cup, the motor is provided inside the impeller cup, the housing includes a housing portion housing the rotor, and a base portion supporting the motor, the bearing being configured to rotatably support the rotor relative to the base portion, a connection portion is provided to an axial end surface of the base portion and on an inner peripheral side relative to the impeller cup, the first fan unit and the second fan unit are connected to each other via the connection portions in a direction of the rotation axis, the connection portion of the first fan unit is a round tubular part extending in the direction of the rotation axis, the connection portion of the second fan unit has a round tubular shape extending in the direction of the rotation axis, the connection portions are connected to each other by an engagement of an inner peripheral surface of the connection portion of the first fan unit and an outer peripheral surface of the connection portion of the second fan unit, an inner diameter of an inner peripheral surface of the connection portion of the second fan unit is larger than an outer diameter of the bearing, each of the base portions includes a bushing supporting the bearing, and the connection portion is an integral part of an axial end surface of each of the bushing.

2. The axial fan according to claim 1, wherein at least the housing portions are made of resin, and the bushings are made of metal.

3. The axial fan according to claim 1, wherein at least the housing portions are made of metal.

4. The axial fan according to claim 1, wherein the connection portions are connected to each other by thread engagement.

5. The axial fan according to claim 1, wherein the connection portions are connected to each other by engagement based on press-fitting.

6. The axial fan according to claim 1, wherein the axial end surface of each of the base portions is provided with a positioning portion.

7. The axial fan according to claim 1, wherein each of the housing portions includes, on an outer peripheral side thereof, a free exit space for a lead wire to be connected to the motor.

8. An axial fan comprising a pair of fan units, wherein each of the pair of fan units includes a rotor, a motor, and a housing, the rotor includes an impeller cup configured to rotate about a rotation axis, and a fan extending radially from the impeller cup, the motor is provided inside the impeller cup, the housing includes a housing portion housing the rotor, and a base portion supporting the motor, a connection portion is provided to an axial end surface of the base portion and on an inner peripheral side relative to the impeller cup, the pair of fan units is connected to each other via the connection portions in a direction of the rotation axis, the connection portion of one of the pair of fan units is a round tubular part extending in the direction of the rotation axis provided with a female thread on an inner peripheral surface of the round tubular part, and a center of the round tubular part is positioned at a center of the rotation axis, and the connection portion of another of the pair of fan units has a round tubular shape extending in the direction of the rotation axis provided with a male thread on an outer peripheral surface of the connection portion of the another of the pair of fan units, and a center of the round tubular shape is positioned at a center of the rotation axis.

9. An axial fan comprising a pair of fan units, wherein each of the pair of fan units includes a rotor, a motor, and a housing, the rotor includes an impeller cup configured to rotate about a rotation axis, and a fan extending radially from the impeller cup, the motor is provided inside the impeller cup, the housing includes a housing portion housing the rotor, and a base portion supporting the motor, a connection portion is provided to an axial end surface of the base portion and on an inner peripheral side relative to the impeller cup, the pair of fan units is connected to each other via the connection portions in a direction of the rotation axis, the connection portion of one of the pair of fan units is a round tubular part extending in the direction of the rotation axis provided with a female thread on an inner peripheral surface of the round tubular part, and the round tubular part is positioned coaxially with the rotation axis, and the connection portion of another of the pair of fan units has a round tubular shape extending in the direction of the rotation axis provided with a male thread on an outer peripheral surface of the connection portion of the another of the pair of fan units, and the round tubular shape is positioned coaxially with the rotation axis.

* * * * *